US011828489B2

(12) United States Patent
Lindsay

(10) Patent No.: US 11,828,489 B2
(45) **Date of Patent: *Nov. 28, 2023**

(54) PRESSURIZED ODOR CONTAINMENT AND ELIMINATION DEVICE

(71) Applicant: Shanel A. Lindsay, Roslindale, MA (US)

(72) Inventor: Shanel A. Lindsay, Roslindale, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/991,414

(22) Filed: Nov. 21, 2022

(65) Prior Publication Data

US 2023/0084401 A1 Mar. 16, 2023

Related U.S. Application Data

(63) Continuation of application No. 17/590,311, filed on Feb. 1, 2022, now Pat. No. 11,506,407.

(60) Provisional application No. 63/144,356, filed on Feb. 1, 2021.

(51) Int. Cl.

| | |
|---|---|
| ***F24F 8/50*** | (2021.01) |
| ***F24F 8/108*** | (2021.01) |
| ***A62B 7/10*** | (2006.01) |
| ***F24F 8/10*** | (2021.01) |

(52) U.S. Cl.

CPC ..... *F24F 8/50* (2021.01); *A62B 7/10* (2013.01); *F24F 8/10* (2021.01)

(58) Field of Classification Search

CPC ..... B01D 46/2411; A61L 9/16; F24F 8/50; F24F 8/97

USPC ..... 55/471, 472; 128/205.27; 131/330, 194, 131/212.2; 454/253

See application file for complete search history.

(56) References Cited

U.S. PATENT DOCUMENTS

| | | | | |
|---|---|---|---|---|
| 3,575,167 A | | 4/1971 | Michielsen | |
| 3,867,936 A | * | 2/1975 | Kelley | A61M 16/0093 128/205.12 |
| 4,019,509 A | | 4/1977 | Li et al. | |
| 4,292,967 A | | 10/1981 | Pasternack | |
| 4,292,978 A | | 10/1981 | Guth | |

(Continued)

FOREIGN PATENT DOCUMENTS

| | | | |
|---|---|---|---|
| JP | 2009261319 | A | 11/2009 |
| WO | 2022165410 | A1 | 8/2022 |

*Primary Examiner* — Minh Chau T Pham

(74) *Attorney, Agent, or Firm* — Mintz Levin Cohn Ferris Glovsky and Popeo, P.C.

(57) ABSTRACT

An odor containment and elimination device includes a containment center, first pathway, second pathway, and third pathway. The containment center can be configured to receive an odorous item that emits a contaminated air including an odor. The first pathway can be in fluid communication with the containment center and an outside environment and configured to allow contaminated air to travel from the containment center to a first release point while inhibiting seeping of the contaminated air from the first pathway into the outside environment prior to the first release point. The second pathway can be in fluid communication with the containment center and the outside environment via a first intake. The third pathway can be in fluid communication with the containment center and the outside environment and configured to reduce contaminated air released into the environment and/or direct the contaminated air through a door or window.

30 Claims, 7 Drawing Sheets

(56) References Cited

U.S. PATENT DOCUMENTS

| | | | | |
|---|---|---|---|---|
| 5,388,595 | A | 2/1995 | Shafer | |
| 5,778,607 | A | 7/1998 | Edwards | |
| 5,819,756 | A | 10/1998 | Mielordt | |
| 6,006,757 | A | 12/1999 | Lichtenberg | |
| 6,156,088 | A | 12/2000 | Cardarelli | |
| 6,638,330 | B1 | 10/2003 | Bergami | |
| 6,976,488 | B2 * | 12/2005 | Halperin | A61M 16/1045 128/205.12 |
| 11,506,407 | B2 * | 11/2022 | Lindsay | F24F 8/108 |
| 2006/0107965 | A1 | 5/2006 | Marshall | |
| 2006/0111036 | A1 | 5/2006 | Leask | |
| 2007/0089387 | A1 * | 4/2007 | Ramos | A62B 23/06 55/505 |
| 2007/0119457 | A1 | 5/2007 | Barrick | |
| 2007/0283971 | A1 | 12/2007 | Gidding | |
| 2011/0155150 | A1 * | 6/2011 | Al-Qassem | A61L 9/16 131/238 |
| 2016/0367927 | A1 | 12/2016 | Blackley | |
| 2018/0116276 | A1 | 5/2018 | Prog et al. | |
| 2022/0243936 | A1 | 8/2022 | Lindsay | |

* cited by examiner

PRESSURIZED ODOR CONTAINMENT AND ELIMINATION DEVICE

CROSS-REFERENCE TO RELATED APPLICATIONS

This application is a continuation of U.S. patent application Ser. No. 17/590,311, filed on Feb. 1, 2022, and entitled "Pressurized Odor Containment and Elimination Device," now U.S. Pat. No. 11,506,407, which claims the benefit of U.S. Provisional Patent Application No. 63/144,356, filed on Feb. 1, 2021, and entitled "Pressurized Odor Containment and Elimination Device," the entirety of which are incorporated by reference.

TECHNICAL FIELD

This description is related to odor containment, reduction and elimination.

BACKGROUND

It is challenging to contain the smell of odorous items and prevent the smell from emanating into the surrounding airspace and area. Some odor reduction tools treat an odor only after it has been released into the surrounding air. Others are unable to fully contain emitted odors, and instead allow scents, aerosols, vapors or particulate to escape into the surrounding environment while the user is interacting with the smelly substance.

SUMMARY

Provided herein is a pressurized odor eliminating device that can be used to prevent scents, aerosols, vapors or particulates emitted by highly odorous items from entering the airspace of a room or surrounding area.

In an embodiment, an odor containment and elimination device is provided. The device can include a containment center, a first pathway, a second pressurized pathway, and a third pressurized pathway. The containment center can be configured to receive an odorous item that emits a contaminated air including an odor. The first pathway can be in fluid communication with the containment center and an outside environment. The first pathway can be configured to allow flow of the contaminated air to travel from the containment center to a first release point while inhibiting seeping of the contaminated air from the first pathway into the outside environment prior to the first release point. The second pathway can be in fluid communication with the containment center and the outside environment via a first intake. The third pathway can be in fluid communication with the containment center and the outside environment. The third pathway can be configured to perform at least one of reducing contaminated air released into the environment or directing the contaminated air through a door or window.

In another embodiment, the device can further include an air flow director in fluid communication with at least one of the second pathway and the third pathway.

In another embodiment, the air flow director can include a pressurized intake, a pressurized exhaust, or a combination thereof.

In another embodiment, at least one of the first pathway, the second pathway, or the third pathway is releasably attached to the containment center.

In another embodiment, the second release point is configured to be placed within the door or window.

In another embodiment, the third pathway includes an air filter. The air flow director can further include a pressurized exhaust in fluid communication with the third pathway and the air flow director can be configured to draw contaminated air from the containment center to outside environment through the air filter.

In an embodiment, an odor containment and elimination device is provided. The device can include a containment center, a first release point, and a first pressurized pathway. The containment center can be configured to receive an odorous item that emits a first contaminated air including an odor. The first release point can be in communication the containment compartment and with an outside environment. The first pressurized pathway can be configured to receive at least portion of the first contaminated air from the containment center. The first pressurized pathway can also be configured to receive at least a portion of a second contaminated air exhaled by a user. The first pressurized pathway can be further configured to direct the received first and second contaminated air to a second release point that is in fluid communication with the outside environment and is different from the first release point.

In another embodiment, the device can further include an air flow director in fluid communication with the first pressurized pathway.

In another embodiment, the device can further include a second pressurized pathway including the second release point.

In another embodiment, the second release point is configured to be placed within a door or window.

In another embodiment, the second pressurized pathway includes an air filter.

In an embodiment, an odor containment and elimination device is provided. The device can include a containment center, a first release point, and a first air flow director. The containment center can be configured to receive an odorous item that emits a first contaminated air including an odor. The first release point can be in fluid communication with the containment center and with an outside environment. The first air flow director can be in fluid communication with the outside environment and the containment center. The first air flow director can be configured to pull at least portion of the first contaminated air from the containment center and at least a portion of a second contaminated air exhaled by a user along a flow pathway to a second release point.

In another embodiment, the device can further include a filter positioned within the flow pathway and configured to filter the first contaminated air and the second contaminated air.

In another embodiment, the first release point includes a mouthpiece.

In another embodiment, the device can further include the air flow director within the mouthpiece.

In another embodiment, the first release point and the air flow director are formed as a single piece that is dimensioned to cover a human nose and mouth.

In another embodiment, the device can further include at least one fragrance enhancer positioned within the air flow pathway.

In an embodiment, an odor containment and elimination device is provided. The device can include a containment compartment and a first pressurized pathway. The containment compartment can be configured to receive an odorous item that emits a contaminated air including an odor. The first pressurized pathway can be in fluid communication with the containment compartment and configured to receive at least a portion of a second contaminated air exhaled by a user, and to push the second contaminated air through a filter to a release point in fluid communication with an outside environment.

The details of one or more implementations of the invention are set forth in the accompanying drawings and descriptions below. Other features, objects and advantages of the invention will be apparent from the description and drawings, and from the claims.

DESCRIPTION OF DRAWINGS

These and other features will be more readily understood from the following detailed description taken in conjunction with the accompanying drawings, in which.

Figure 1:
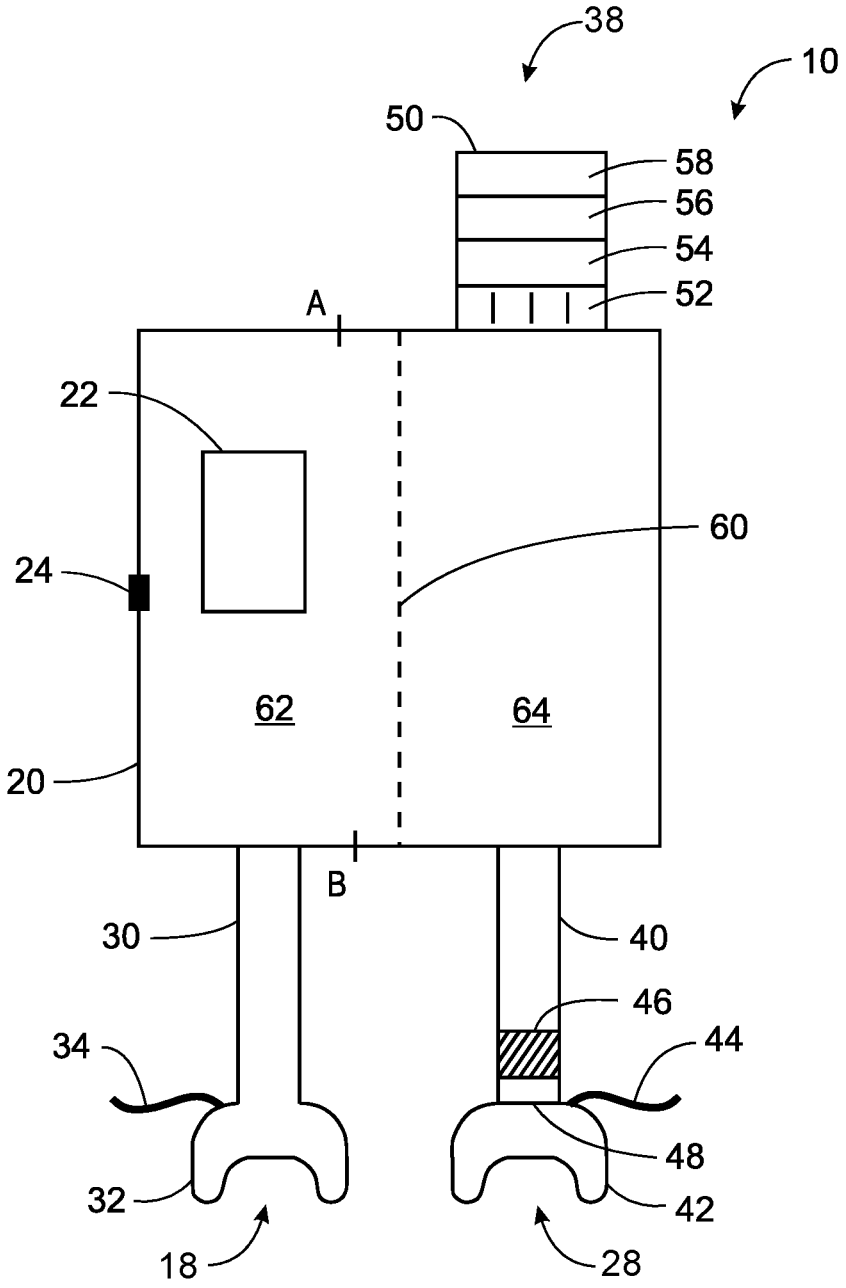
FIG. 1 is an illustration of an exterior view of one example implementation of a pressurized odor containment and eliminating device.

It is noted that the drawings are not necessarily to scale. The drawings are intended to depict only typical aspects of the subject matter disclosed herein, and therefore should not be considered as limiting the scope of the disclosure. Like reference symbols in the various drawings indicate like elements.

DETAILED DESCRIPTION

The pressurized odor containment and eliminating device described herein uses containment techniques and strategic air flow to control and eliminate odors stemming from a variety of scents, aerosols, vapors, particulates and other smells. These odors may be created via any number of scenarios. For example, manipulation, heating, vaporizing, smoking or other combustion of materials can result in the creation of scents, aerosols, vapors, particulates and other smells. Highly odorous items can release these scents, aerosols, vapors, particulates and other smells, creating contaminated air that easily pervades the surrounding environments.

As used herein, contaminated air is air that may include, but is not limited to, one or more of undesirable, offensive, or harmful scents, aerosols, vapors, particulates, smells, or odors. Put another way, contaminated air contains components that are targeted for removal from the air. Contaminated air may also include viruses, bacteria, or other polluting substances that can degrade air quality. The scents, aerosols, vapors, particulates, smells, and odors may originate from highly odorous items without interaction or manipulation. The scents, aerosols, vapors, particulates, smells, and odors may also be generated by interactions, manipulations, heating, burning, or combusting various items. The creation of contaminated air by the release of scents, aerosols, vapors, particulates, smells, and odors when manipulating various materials creates difficulties in private or discrete interaction with highly odorous items. Moreover, the scents, aerosols, vapors, particulates, smells, and odors from these highly odorous items may unintentionally enter the airspaces of nearby spaces or rooms. For example, in a multi-space environment, scents, aerosols, vapors, particulates, smells, and odors that originate from a highly odorous item in a first space may spread to a second space where the scents, aerosols, vapors, particulates, smells, and odors are less desirable.

In an implementation, a device as described herein includes a central containment unit with at least one pressurized pathway. Using the central containment unit and at least one pressurized pathway, implementations of the present techniques may be configured to trap, attract, and/or eliminate at least one of scents, aerosols, vapors, particulates, smells, or odors. By contrast, traditional odor elimination devices are unable to contain odors and instead purport to filter contaminated air within a room or space. The contaminated air may be offensive for any number of reasons, and implementations of the present techniques may remove offensive qualities of the air. Other traditional odor elimination techniques fail to prevent contaminated air from seeping into the outside airspace and are unable to contain odors released into the airspace.

Accordingly, implementations of the present techniques enable containment and elimination of contaminated air. In implementations, the present device includes at least one containment center or a containment compartment. For example, the contaminated air may originate from within a containment center. The contaminated air may be intentionally transferred from the containment center via a first pathway in fluid communication with (e.g., leading to) a first release point. The first pathway may be configured to enable the transmission of contaminated air without seeping or releasing the contaminated air from the first pathway or the containment center into the airspace of the outside environment. That is, the first pathway may be substantially fluid-tight, as discussed in greater detail below. The device may also include a second pressurized pathway leading to the containment center from a first injection point. Contaminated air (e.g., contaminated air exhaled by a user) may be transferred to the containment center, through the second pressurized pathway, at the first injection point. Further, the device may also include a third pressurized pathway leading from the containment center to a second release point. The third pressurized pathway directs air to a second release point, and may be configured to eliminate or reduce odors in the contaminated air. The second release point may be located within an available room, space, door or window. Using one or more pathways, implementations of the device according to the present techniques enables interaction with highly odorous items while containing, attracting, and/or eliminating odors, preventing them from pervading the room or area.

FIG. 1 is an illustration of an exterior view of an implementation of a pressurized odor containment and eliminating device 10. The pressurized odor eliminating device 10 includes a containment center 20. The containment center 20 may be in fluid communication with each of a first pathway 30, a second pathway 40, and a third pathway 50. At least one of the pathways 30, 40, and 50 may be releasably attached to the containment center 20. The connections between one or more of (e.g., each of) the pathways 30, 40, and 50 may be airtight and able to withstand pressurization. For example, any number of seals, valves, or devices used to control the flow of gas or enable pressurization may be present along or at various ends of each of the pathways 30, 40, or 50. For ease of illustration, the containment center 20 is illustrated as square in shape. However, the containment center 20 can be of any shape. Additionally, implementations of the containment center 20 and one or more of (e.g., each of) the pathways 30, 40, and 50 may be washable or otherwise able to be cleaned. The containment center 20 can contain one or more clear, see-through, or transparent portions in order to make visible the interior of containment center 20.

The containment center 20 may include a re-closable opening 22 configured to enable highly odorous items to be inserted into the containment center 20. When inserted into the containment center 20, the highly odorous items may be completely sealed off from the airspace of the surrounding environment. The containment center 20 has a tool portal 24 that creates an opening into the containment center 20 for the insertion of utensils into the containment center 20. Utensils may be, for example, adjusters, lighters, stampers, or any other tool used to manipulate or interact with materials placed inside of the containment center 20.

In operation, highly odorous items may be placed inside the containment center 20 and utensils can be inserted via the tool portal 24 to interact with, manipulate, or otherwise control the highly odorous items within the containment center 20. In implementations, the re-closable opening 20 and tool portal 24 are configured with seals, valves, or other features that enable the re-closable opening 20 and tool portal 24 to be airtight.

As used herein, airtight may refer to preventing air contained in a first airspace from seeping or releasing into a second airspace. For example, a first airspace inside of the containment center 20 is sealed off and distinct from the airspace of the surrounding environment. In particular, a first airspace inside of the containment center 20 may not release or seep into the airspace of the surrounding environment. Accordingly, in certain implementations, the airspace inside of the containment center 20 is airtight in relation to the airspace of the surrounding environment. In implementations, at least one of, and up to all of, the containment center 20, re-closable opening 22, tool portal 24, first pathway 30, second pathway 40, or third pathway 50 are airtight to trap contaminated air within the containment center 20 and prevent the contaminated air from escaping into the outside airspace.

The first pathway 30 is an airtight pathway coupled with a mouthpiece 32. The first pathway 30 and the mouthpiece 32 may form a single component. Alternatively, the first pathway 30 and the mouthpiece 32 may be two distinct components that are releasably coupled. The first pathway 30 and mouthpiece 32 can be composed of a variety of materials, including plastics, metals, or any other type of airtight material, whether flexible or rigid, that can be configured into a tube or path through which contaminated air can travel. The mouthpiece 32 connected to the first pathway 30 can be fixed or detachable, and can taper into a narrow, straw-like tip or be configured to cover the entire mouth, nose, or face. A tether 34 can be releasably coupled to the first pathway 30, mouthpiece 32, or any combination thereof, enabling the first pathway 30 or mouthpiece 32 to be attached to a user's hand, head, or a stand. The tether 34 may stabilize the first pathway 30 and mouthpiece 32 for ease of use.

Implementations of the second pathway 40 can adopt the form of an airtight, pressurized pathway coupled with a mouthpiece 42. The second pathway 40 and the mouthpiece 42 may form a single component. Alternatively, the second pathway 40 and the mouthpiece 42 may be two distinct components that are releasably coupled. The second pathway 40 and mouthpiece 42 can be composed of a variety of materials, including plastics, metals, or any other type of airtight material, whether flexible or rigid, that can be configured into a tube or path through which contaminated air can travel. The mouthpiece 42 connected to the second pathway 40 can be fixed or detachable, and can taper into a narrow, straw-like tip or be configured to cover the entire mouth, nose, or face. A tether 44 can be releasably coupled to the second pathway 40, mouthpiece 42, or any combination thereof, enabling the second pathway 40 or mouthpiece 42 to be attached to a user's hand, head, or a stand. The tether 44 may stabilize the second pathway 40 and mouthpiece 42 for ease of use.

In operation, the first pathway 30 may be used to remove contaminated air from within the containment center 20 at a first release point 18. The first release point 18 can be in fluid communication with the environment and it can include a terminal end of the first pathway 30 and/or a region of the environment adjacent to the terminal end of the first pathway 30. For example, plant material may be placed within the containment center 20 via the re-closable opening 22. The plant material may be contained within a smoking bowl, rolling papers, or other materials. A user can interact with the plant material within the containment center 20 using the tool portal 24. For example, a user may interact with, manipulate, heat, burn, or combust the plant material inside the containment center via lighters, adjusters, stampers, vaporizers, heaters, and the like. As the user interacts with the plant material inside of the containment center 20 via the tool portal 24, the user may also remove contaminated air generated within the containment center 20. For example, a user may inhale the air created in the containment center 20 at the first release point 18 via the first pathway 30 and mouthpiece 32. Contaminated air may be returned or injected into the containment center 20 at a first injection point 28 via the second pathway 40 and mouthpiece 42. That is, the first injection point 28 can be a terminal end of the second pathway 40 and/or a region of the environment adjacent to the terminal end of the second pathway 40 and in fluid communication with the environment. For example, the user may exhale air into the second pathway 40 and the mouthpiece 42. The exhaled air may be contaminated air that was inhaled from the containment center 20 via the first pathway 30 and mouthpiece 32.

For ease of description, the mouthpieces 32 and 42 are illustrated as separate and distinct components in the example of FIG. 1. Additionally, the first pathway 30 and the second pathway 40 are illustrated as separate and distinct pathways. However, the mouthpieces 32 and 42 may be combined into a single unit where seals, valves, or switches are used to select the functionality of a mouthpiece 32 or a mouthpiece 42 from a single unit. Mouthpieces 32 and 42 can also remain separate and each have one or more offshoots, creating multiple mouthpieces where the mouthpiece 32, mouthpiece 42, or any combination thereof form a central mouthpiece unit. Additionally, the mouthpiece 32 or mouthpiece 42 can be ornamental. The pathways 30 and 40 may be combined into a single pathway, where seals, valves, switches, or other components are used to select the functionality of the first pathway 30 or the second pathway 40. The pathways 30 and 40 may be combined into a single tube with a plurality of pathways, where seals, valves, switches, or other components are used to select the functionality of the first pathway 30 or the second pathway 40.

As illustrated, the second pathway 40 is coupled with a pressurized intake 46. The pressurized intake 46 pulls air from the airspace outside of the containment center 20 into the containment center 20. In the example of FIG. 1, the pressurized intake 46 is a fan. The pressurized intake 46 may be any device configured to create a negative air pressure in the containment center 20. Generally, a negative air pressure within the containment center 20 is a pressure that is lower than the air pressure outside of the containment center 20. The negative air pressure within the containment center 20 prevents air within the containment center from escaping into the airspace of the surrounding environment. In this manner, the contaminated air created within the containment center 20 (e.g., emitted by the odorous item(s)) or injected into the containment center 20 via the first pathway 30 can be isolated within the containment center 20. In implementations, contaminated air from within the containment center 20 may be released in a controlled manner at the first and second release points.

For ease of description, negative air pressure is described as being created by the pressurized intake 46. However, a negative air pressure can be created within the containment center 20 by pulling air into the containment center 20. The pressurized intake 46 may be any device configured to create a negative air pressure within the containment center 20 when compared to the airspace of the environment external to the containment center 20. In implementations, the pressurized intake 46 contains a user interface 48. The user interface 48 is configured to allow a user control of the function of the pressurized intake 46. For example, the user interface 48 may enable a user to turn the pressurized intake function on/off and to control the force of the intake. The user interface 48 may enable electronic control of the pressurized intake 46. The user interface 48 may also include mechanical control of the pressurized intake 46. In implementations, the user interface 48 may also include an air quality detector.

A third pathway 50 connected to containment center 20 is configured to transfer air from the containment center 20 to a second release point 38. The third pathway 50 is an airtight, pressurized pathway coupled with a pressurized exhaust 52. The third pathway 50 and the pressurized exhaust 52 may form a single component. Alternatively, the third pathway 50 and the pressurized exhaust 52 may be two distinct components that are releasably coupled. The third pathway 50 can be composed of a variety of materials, including plastics, metals, or any other type of airtight material, whether flexible or rigid, that can be configured into a tube or path through which contaminated air can travel. The third pathway 50 may be configured to pull air from the containment center 20 for release at the second release point 38 via the pressurized exhaust 52. The pressure exhaust 52 may cause air within the containment center 20 to be removed from the containment center 20. The pressurized exhaust 52 can be a fan or any other device configured to create a positive air pressure within containment center 20 when compared to the airspace outside of the containment center 20.

In embodiments, the third pathway 50 may contain a user interface 54. The user interface 54 is configured to enable user control of the function of the pressurized exhaust 52. For example, the user interface 54 may enable a user to turn the pressurized exhaust function on/off and to control the force of the exhaust. The user interface 54 may enable electronic control of the pressurized exhaust 52. The user interface 54 may also enable mechanical control of the pressurized exhaust 52. In embodiments, the user interface 54 may also include an air quality detector.

The third pathway 50 may also include an air filter 56. The air filter 56 may reduce, neutralize, or eliminate odors in the contaminated air traveling through the third pathway 50. The filter may be formed from a variety of materials and types, including charcoal, high-efficiency particulate air (HEPA), carbon, electrostatic, or any other form or materials configured to reduce or remove odor or particulate from the air present in third pathway 50.

Additionally, the third pathway 50 may also contain a fragrance enhancer 58. The fragrance enhancer 58 may contain substances to scent air that travels through the third pathway 50. The substances may be, for example essential oils, perfumes, or other fragrances. In implementations, the fragrance enhancer 58 can be removable or refillable. Additionally, the rate at which substances are added to the contaminated air can be adjustable in order to control the strength of fragrance applied to the contaminated air.

For ease of description, the pressurized exhaust 52, user control 54, air filter 56, and fragrance enhancer 58 are illustrated in a particular configuration with respect to the third pathway 50. However, the pressurized exhaust 52, user control 54, air filter 56, and fragrance enhancer 58 can be placed in any order or orientation along the third pathway 50. Moreover, the pressurized exhaust 52, user control 54, air filter 56, and fragrance enhancer 58 may be merged to create one or more units. Additionally, the pressurized exhaust 52, user control 54, air filter 56, and fragrance enhancer 58 may be present at other locations of the device 10.

The containment center 20 has one or more dividers 60 that segment the containment center 20 into one or more portions. For ease of description, a single divider 60 is illustrated. However, the containment center may have any number of dividers. Moreover, the dividers 60 may have any number of apertures or openings. As illustrated, the divider 60 separates the containment center 20 into a first portion 62 and a second portion 64. The first portion 62 may be configured to maintain a lower air pressure when compared to the second portion 64. The first portion 62 may include the re-closable opening 22, tool portal 24, and first pathway 30. The apertures of the divider 60 may be adjustable. In this manner, a rate of combustion, burning, heating, or vaporizing within the first portion 62 may be controlled via a manipulation of the divider 60 or the apertures. The second portion 64 may include the second pathway 40 and third pathway 50.

The block diagram of FIG. 1 is not intended to indicate that the device 10 is to include all of the components shown in FIG. 1. Rather, the device 10 can include fewer or additional components not illustrated in FIG. 1 (e.g., additional openings, tool portals, mouthpieces, pathways, filters, etc.). The device 10 may include any number of additional components not shown, depending on the details of the specific implementation. Furthermore, any of the functionalities of the user interfaces may be partially, or entirely, implemented in hardware and/or in a processor. For example, the functionality may be implemented with an application specific integrated circuit, in logic implemented in a processor, in logic implemented in a specialized graphics processing unit, or in any other device.

Figure 2:
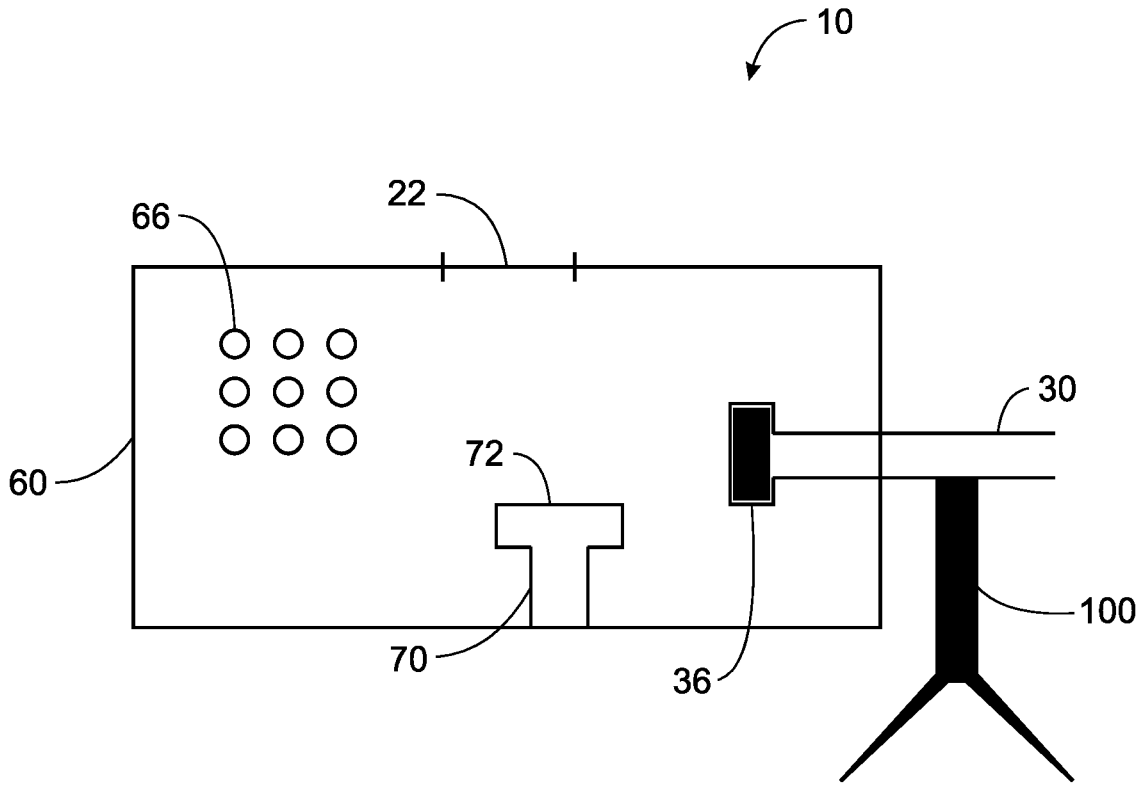
FIG. 2 is a cross section of the pressurized odor containment and eliminating device of FIG. 1.
Figure 3:
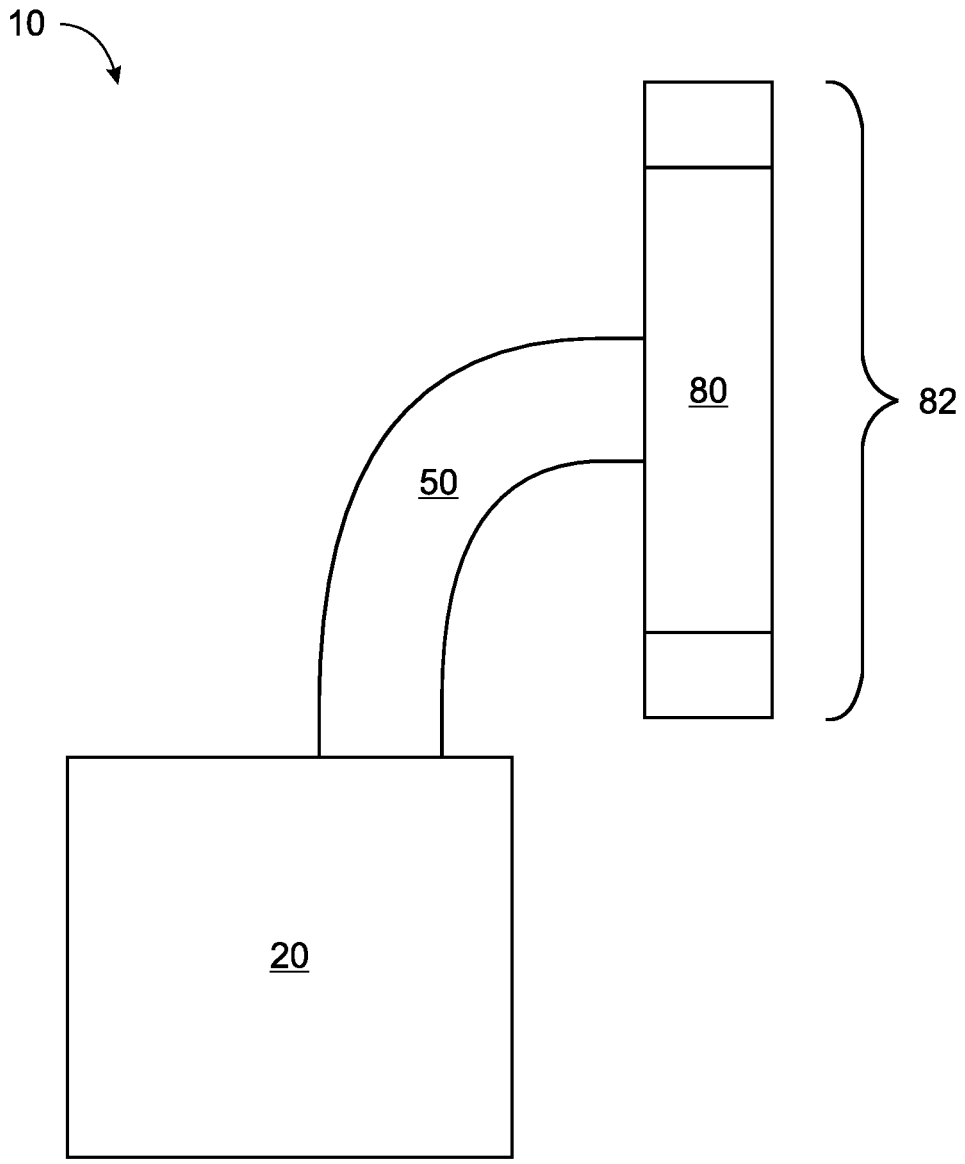
FIG. 3 is an external view of an implementation of the pressurized odor containment and eliminating device including a diffuser.

FIG. 2 is a cross-section of the pressurized odor containment and eliminating device 10 taken from a line formed by point A and point B of FIG. 1. As illustrated in FIGS. 2 and 3, the containment center includes a divider 60, a material holder 70, and the first pathway 30. As illustrated, the divider 60 has a number of apertures 66 that enable a controllable air flow from the first portion 62 of the containment center 20 to the second portion 64 of the containment center 20. The apertures 66 can be a variety of sizes and can be adjustable to control the air flow from a first section to a second section of the containment center 20. For ease of illustration, the apertures 66 are illustrated as circular in shape. However, the apertures 66 may be of any shape, size, and number. In some cases, the divider 60 may be solid and without apertures 66. The divider 60 may also be a porous material with apertures 66 that are not immediately visible to the human eye. The size and shape of each aperture 66 may be electrically adjustable. The size and shape of each aperture 66 may be mechanically adjustable. In implementations, the air flow and/or air pressure may be controlled, at least in part, by adjusting the apertures 66.

With further reference to FIG. 3, the material holder 70 may be coupled with a platform 72 within the containment center 20. As discussed with respect to FIG. 1, a user may interact with, manipulate, heat, burn, or combust various items in the first portion 62 of the containment center 20 (FIG. 1). The material holder 70 and platform 72 may be located within the first portion 62 of the containment center 20. In operation, odor emitting materials can be placed on or within the platform 72. In implementations, utensils (such as the utensils discussed with respect to FIG. 1) may be fashioned to be complimentary to the material holder 70 and platform 72. The material holder 70 and platform 72 may be adjustable or expandable in order to raise the odorous substance to a variety of heights and hold a variety of substance sizes. Moreover, the material holder 70 and platform 72 can be multi-faceted, expandable, customizable, or adjustable to hold thin items like incense and rolled herbal blends, or larger items like a glass apparatus, aerosol device or battery operated warmer.

The first pathway 30 can be coupled with a connector 36 that can attach to, stabilize, or hold a variety of items. The connector 36 can be adjustable in order to expand or contract to create a variety of opening sizes and can contain a clip or other securing mechanisms. In operation, the connector 36 may be coupled with material resting on the material holder 70 and platform 72. In implementations, the connector 36 enables a secure link between the material placed inside the containment center 20 and the first pathway 30. In implementations, a stand 100 may be attached to the first pathway 30 in order to hold the first pathway 30 and the mouthpiece 32 in a particular position. The stand 100 can be made from a variety of materials and can be flexible, allowing them to stand on a flat surface like a table or be clipped, wrapped or otherwise anchored to a variety of surfaces. In FIG. 2, stand 100 is shown supporting first pathway 30. However, in other implementations, the stand 100 can be used to support any of the pathways 30, 40 or 50.

The block diagram of FIG. 2 is not intended to indicate that the device 10 is to include all of the components shown in FIG. 2. Rather, the device 10 can include fewer or additional components not illustrated in FIG. 1 (e.g., additional dividers, apertures, material holders, platforms, etc.). The device 10 may include any number of additional components not shown, depending on the details of the specific implementation.

FIG. 3 is an external view of an implementation of the pressurized odor containment and eliminating device 10. In the example of FIG. 3, an illustration of air flow from the containment center 20 through the third pathway 50 is provided. The third pathway 50 is coupled with a diffuser 80. In implementations, the diffuser 80 is in addition to, or an alternative to, a fragrance enhancer 58. The diffuser 80 may be fitted over the exhaust outlet created by the third pathway 50 removing contaminated air from within the containment center 20. The diffuser 80 may be configured to cause the contaminated air from within the containment center 20 to be broken up or spread across a large area. Thus, the diffuser 80 can be of any size or shape to fit a variety of openings. As illustrated, the diffuser 80 is placed within a window 82. During operation, the diffuser 80 may spread or scatter the contaminated air from the containment center 20 so that the resulting air disperses into the surrounding environment without creating an area of densely contaminated air. The diffuser 80 can be made of a variety of solid materials and sized to fit any opening, such as a door, window, vent, and the like. In implementations, diffuser 80 has expanding and contracting elements in order to easily resize for different applications.

The block diagram of FIG. 3 is not intended to indicate that the device 10 is to include all of the components shown in FIG. 3. Rather, the device 10 can include fewer or additional components not illustrated in FIG. 3 (e.g., additional diffusers, pathways, etc.) The device 10 may include any number of additional components not shown, depending on the details of the specific implementation.

Figure 4:
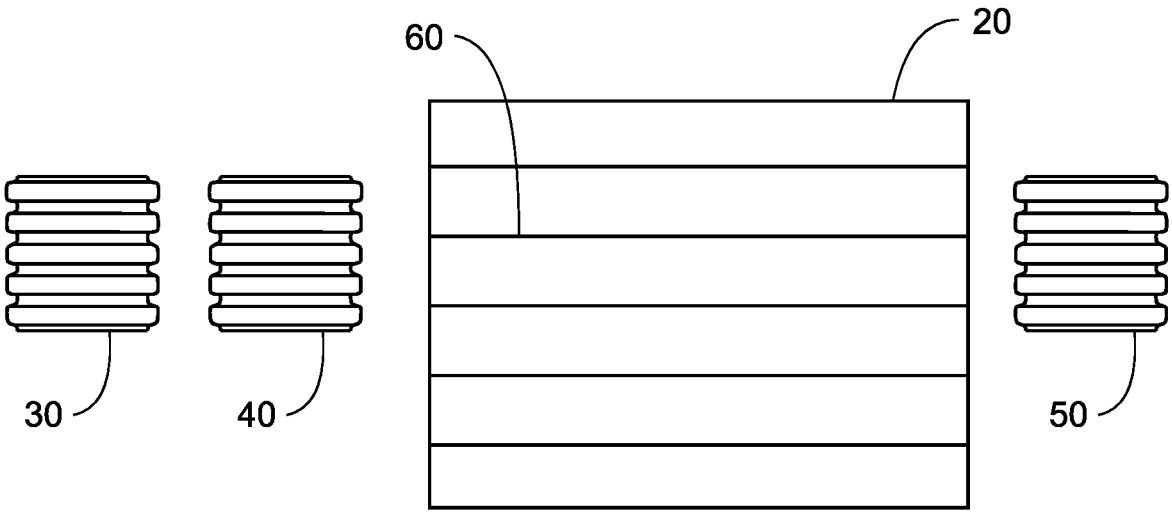
FIG. 4 is illustration of an implementation of a disassembled pressurized odor containment and eliminating device with the first, second and third pathways disconnected.

FIG. 4 is illustration of a disassembled pressurized odor containment and eliminating device 10 with the first, second and third pathways 30, 40, 50 disconnected. In the example of FIG. 4, components of the device 10 are separated and prepared for cleaning, storage, or transport. The containment center 20 may be disassembled into stackable pieces with the first pathway 30, second pathway 40 and third pathway 50 disconnected and compressed for storage. Other components, such as the utensils, re-closable opening 22, tool portal 24, mouthpiece 32, tether 34, mouthpiece 42, tether 44, pressurized intake 46, user interface 48, pressurized exhaust 52, user interface 54, air filter 56, fragrance enhancer 58, dividers 60, material holder 70, platform 72, and stand 100 may also be separated and stored, cleaned, or transported.

The block diagram of FIG. 4 is not intended to indicate that the device 10 is to include all of the components shown in FIG. 4. Rather, the device 10 can include fewer or additional components not illustrated in FIG. 1 (e.g., additional pathways, dividers, etc.). The device 10 may include any number of additional components not shown, depending on the details of the specific implementation. Moreover, the block diagram of FIG. 4 is an example illustration of a disassembled device 10. The arrangement of the pathways and containment center as illustrated should not be viewed as limiting.

Figure 5:
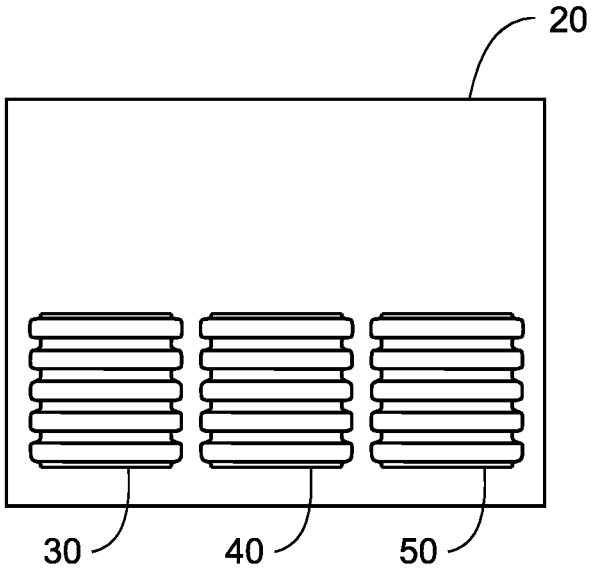
FIG. 5 is a cross-section of an implementation of the pressurized odor containment and eliminating device with the first, second, and third pathways disconnected and positioned for storage.

FIG. 5 is a cross-section of an implementation of the pressurized odor containment and eliminating device 10 with the first, second and third pathways 30, 40, 50 disconnected and positioned for storage. In the example of FIG. 5, the pressurized odor eliminating device 10 is illustrated with the first pathway 30, second pathway 40, and third pathway 50 disconnected placed inside the containment center 20 for storage. Other components, such as the utensils, re-closable opening 22, tool portal 24, mouthpiece 32, tether 34, mouthpiece 42, tether 44, pressurized intake 46, user interface 48, pressurized exhaust 52, user interface 54, air filter 56, fragrance enhancer 58, dividers 60, material holder 70, platform 72, and stand 100 may also be stored within the containment center 20 for a discreet and compact storage solution. Moreover, the other components may be compressed or strategically attached to the containment center 20 for storage.

The block diagram of FIG. 5 is not intended to indicate that the device 10 is to include all of the components shown in FIG. 5. Rather, the device 10 can include fewer or additional components not illustrated in FIG. 1 (e.g., additional pathways, dividers, etc.). The device 10 may include any number of additional components not shown, depending on the details of the specific implementation. Moreover, the block diagram of FIG. 5 is an example illustration of the device 10 in a disassembled state configured for storage, transport, or any other scenario where a compact, disassembled device is preferred. The arrangement of the pathways and containment center as illustrated should not be viewed as limiting.

Figure 6:
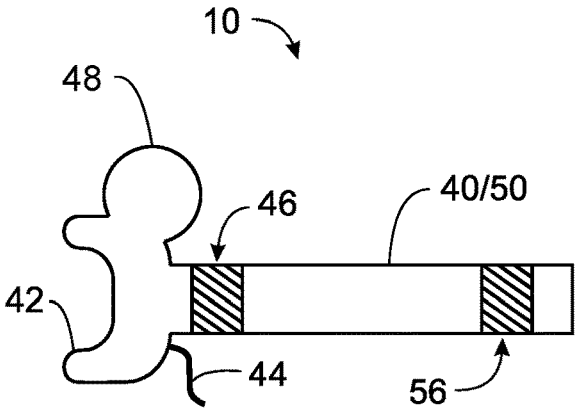
FIG. 6 is an illustration of an exterior view of an implementation of a pressurized odor containment and eliminating device including a containment compartment.

FIG. 6 is an illustration of an exterior view of a pressurized odor containment and eliminating device 10 with a containment compartment 48. In the example of FIG. 6, a mouthpiece 42 and tether 44 may be attached to the pathway 40. As illustrated, a pressurized intake 46 may be located at or near the pathway 40. An embodiment of the containment compartment 48 is also illustrated. The containment compartment 48 may be releasably attached to the mouthpiece 42, or the containment compartment 48 may be permanently coupled with the mouthpiece 42. Thus, the containment compartment 48 may be connected to pathway 40/50 or incorporated into mouthpiece 42. For ease of illustration, the containment compartment 48 is illustrated as a spherical area coupled with the mouthpiece 42. However, in alternative embodiments, the containment compartment can be of any shape or size.

The containment compartment 48 may house the odorous item(s), allowing the user to interact with, inhale or manipulate the item(s) at a first release point of the compartment 48 and then exhale into the injection point at the mouthpiece 42. In embodiments, the mouthpiece 42 enables both a first release point (e.g., the first release point 18 shown in FIG. 1) and a first injection point (e.g., the second release point 28 shown in FIG. 1). In operation, a user may open/close or select between an injection or release point functionality at the mouthpiece 42 as needed. For example, when a user inhales contaminated air contained in the containment compartment 48, release point functionality may be selected at the mouthpiece 42. When release point functionality is selected, the coupling between the containment compartment 48 and mouthpiece 42 may be open. When a user exhales air into the pressurized pathway 40/50, injection point functionality may be selected at the mouthpiece 42. When injection point functionality is selected, the coupling between the containment compartment 48 and mouthpiece 42 may be closed. The opening and closing of the airspace within the containment compartment 48 may be mechanically controlled. The opening and closing of the airspace within the containment compartment 20 may be electronically controlled. A user may select release point or injection point functionality using a user interface, such as the user interface 48 or the user interface 54 described with respect to FIG. 1.

In the device illustrated in FIG. 6, the pathway 40/50 is illustrated at having both a pressurized intake 46 and a pressurized exhaust 52 at opposing ends of the pathway 40/50. However, the pressurized intake 46 and pressurized exhaust 52 may form a single unit located at any point along the pathway 40/50. The single unit may pull air from a first injection point (e.g., the first injection point 28 shown in FIG. 1) and release air at a second release point (e.g., the second release point 38 shown in FIG. 1). The pathway 40/50 may clean or otherwise modify the contaminated air within the pathway 40/50 before releasing the air at the second release point 38. Accordingly, any of a diffuser, filter, fragrance enhancer, fragrance, or any combinations thereof may be present.

The block diagram of FIG. 6 is not intended to indicate that the device 10 is to include all of the components shown in FIG. 6. Rather, the device 10 can include fewer or additional components not illustrated in FIG. 6 (e.g., additional diffusers, pathways, re-closable openings, tool portals, mouthpieces, tethers, pressurized intakes, user interfaces, pressurized exhausts, air filters, fragrance enhancers, dividers, material holders, platforms, stands, etc.). The device 10 of FIG. 6 may include any number of additional components not shown, depending on the details of the specific implementation.

Figure 7:
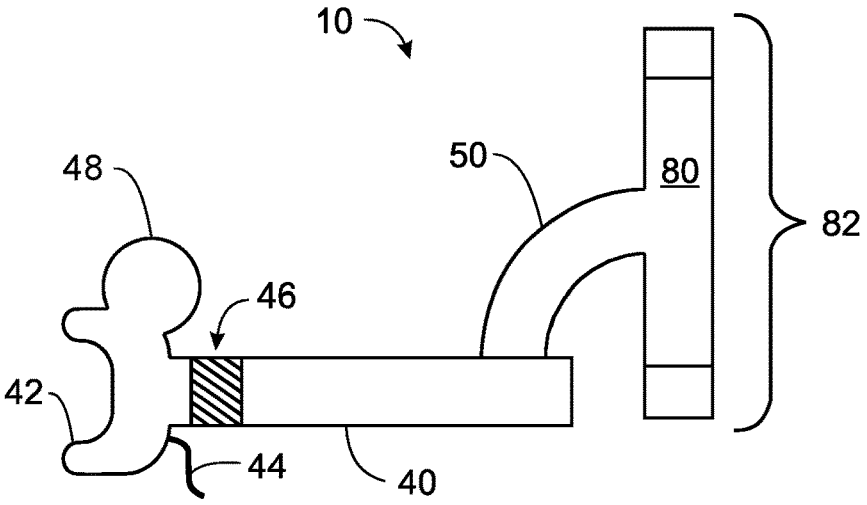
FIG. 7 is an illustration of an exterior view of an implementation of a pressurized odor containment and eliminating device including a containment compartment and a diffuser.

FIG. 7 is an illustration of an exterior view of an implementation of the pressurized odor containment and eliminating device 10 with a containment compartment. In the example of FIG. 7, a mouthpiece 42 and tether 44 may be attached to the pathway 40. As illustrated, a pressurized intake 46 may be located at or near the pathway 40. A containment compartment 48 is also illustrated. The containment compartment 48 may be releasably attached to the mouthpiece 42, or the containment compartment 48 may be permanently coupled with the mouthpiece 42. Thus, the containment compartment 48 may be connected to pathway 40 or incorporated into mouthpiece 42. The containment compartment 48 may house the odorous items, allowing the user to interact with, inhale or manipulate the material at a first release point of the compartment 48 and then exhale into the injection point at pathway 40. For ease of illustration, the containment compartment 48 is illustrated as a spherical area coupled with the mouthpiece 42. However, the containment compartment can be of any shape or size. Moreover, the containment compartment 48 may be able to be completely sealed off from the mouthpiece and the connection between the containment compartment 48 and the mouthpiece 42 can be closed or opened as needed, similar to the containment compartment 48 described with respect to FIG. 6.

In embodiments, the containment compartment 48 may also have a re-closable opening (not illustrated) configured to enable highly odorous items to be inserted into the containment compartment 48. In operation, the re-closable opening may also be the first release point 18 as described above. When inserted into the containment compartment 48, the highly odorous items may be completely sealed off from the airspace of the surrounding environment.

In the device illustrated in FIG. 7, a pathway 40 connects to a pressurized pathway 50. The pressurized pathway 50 may pull contaminated air the pathway 40 into the pathway 50. The pathway 50 may clean or otherwise modify the contaminated air obtained from the pathway 40 before releasing the air at a release point. In implementations, the release point may be an area outside of the current room or space. As illustrated, the pathway 50 may release contaminated air into a diffuser 80 that is connected to a window 82. The diffuser 80 may be fitted over the exhaust outlet created by the pathway 50. The diffuser 80 may be configured to cause the contaminated air from within the pathway 50 to be broken up or spread across a large area. Thus, the diffuser 80 can be of any size or shape to fit a variety of openings.

The block diagram of FIG. 7 is not intended to indicate that the device 10 is to include all of the components shown in FIG. 7. Rather, the device 10 can include fewer or additional components not illustrated in FIG. 7 (e.g., additional diffusers, pathways, re-closable openings, tool portals, mouthpieces, tethers, pressurized intakes, user interfaces, pressurized exhausts, air filters, fragrance enhancers, dividers, material holders, platforms, stands, etc.). The device 10 of FIG. 7 may include any number of additional components not shown, depending on the details of the specific implementation.

Figure 8:
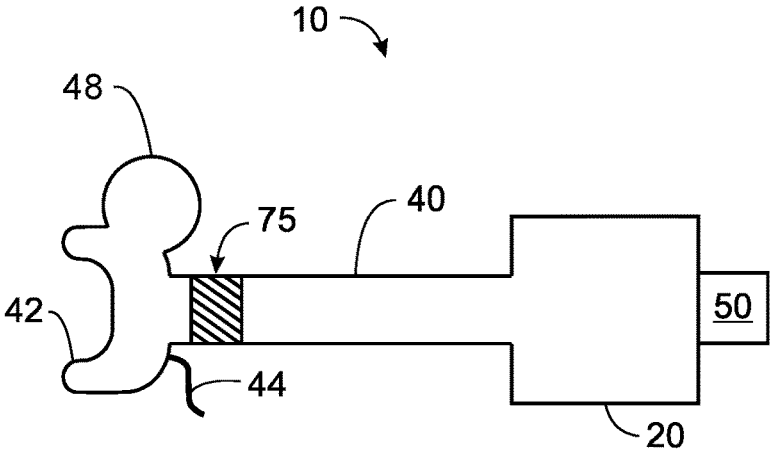
FIG. 8 is an illustration of an exterior view of an implementation of a pressurized odor containment and eliminating device including a containment compartment and a containment center.

FIG. 8 is an illustration of an exterior view of a pressurized odor containment and eliminating device with a containment center and a containment compartment. In the example of FIG. 8, a mouthpiece 42 and tether 44 may be attached to the second pathway 40 via an air flow director 75. The air flow director 75 may be a pressurized intake (e.g., a pressurized intake 46 shown in FIG. 1), a pressurized exhaust (e.g., a pressurized exhaust 52 shown in FIG. 1), or a combination pressurized intake/exhaust unit. The air flow director 75 may cause air from the first injection point 28 to be pulled into the second pathway 40 and pushed into the containment center 20. While the air flow director 75 is illustrated at a particular end of the second pathway 40, the air flow director 75 may be located at any position of the second pathway 40. Additionally, the air flow director 75 may be located within the mouthpiece 42, the containment center 20, or the third pathway 50.

Implementations of the containment compartment 48 of FIG. 8 may be similar to the containment compartments illustrated in FIGS. 6 and 7. For example, the containment compartment 48 may house the odorous item, allowing the user to interact with, inhale or manipulate the material at a first release point of the compartment 48 and then exhale into the injection point at pathway 40. The first release point of the containment compartment 48 can be in fluid communication with the environment and it can include a terminal end of the pathway 40 and/or a region of the environment adjacent to a terminal end of the pathway 40. As illustrated in FIG. 8, the pathway 40 may be coupled with a containment center 20. The containment center 20 may be similar to the containment center 20 described with respect to FIGS. 1-6. The pathway 50 may enable air to be released from the containment center 20 via the second release point 38. Accordingly, pressurized pathway 50, or any combination of its elements, including pressurized pathway 50, filter 52, and fragrance enhancer 58 (FIG. 1) or a wrap may be connected to containment center 20.

The block diagram of FIG. 8 is not intended to indicate that the device 10 is to include all of the components shown in FIG. 8. Rather, the device 10 can include fewer or additional components not illustrated in FIG. 8 (e.g., additional diffusers, pathways, re-closable openings, tool portals, mouthpieces, tethers, pressurized intakes, user interfaces, pressurized exhausts, air filters, fragrance enhancers, dividers, material holders, platforms, stands, etc.). The device 10 of FIG. 8 may include any number of additional components not shown, depending on the details of the specific implementation.

Figure 9:
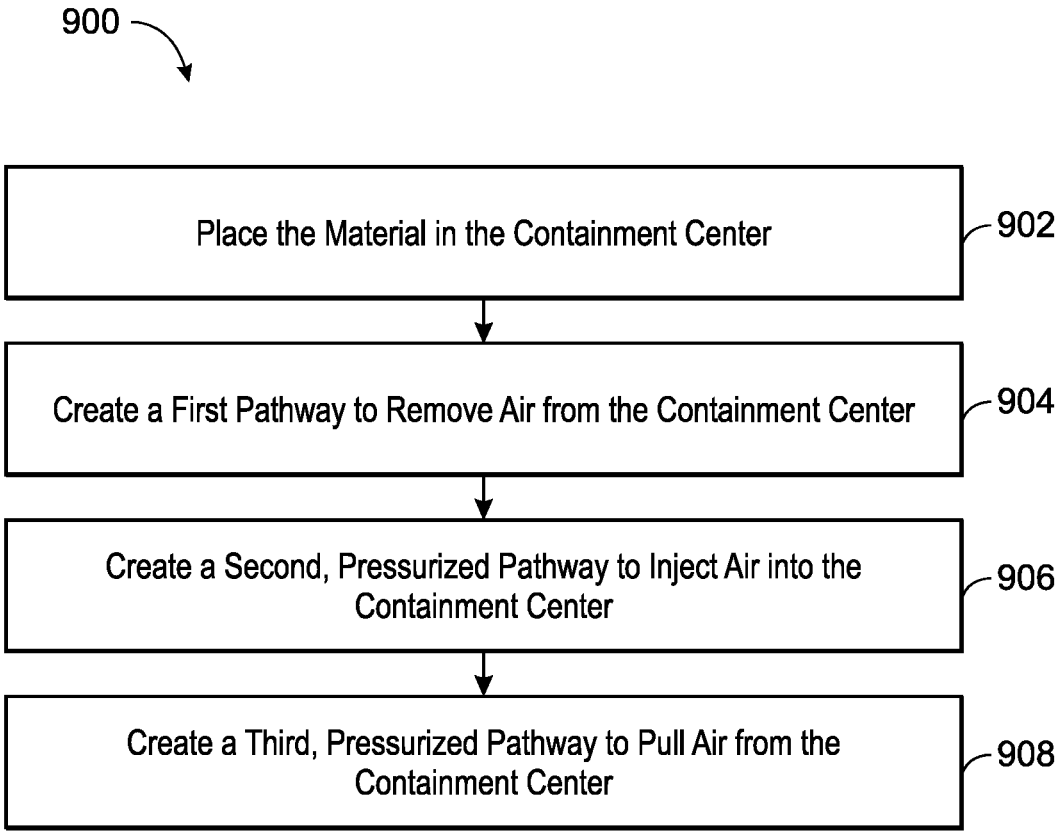
FIG. 9 is a process flow diagram illustrating one example implementation of a process for odor containment and elimination.

FIG. 9 is a process flow diagram illustrating one example implementation of a process 900 for odor containment and elimination. As shown, the process 900 includes blocks 902-908. However, in alternative implementations, the process can include greater or fewer blocks and the blocks can be performed in a different order than illustrated in FIG. 9.

At block 902, an odor emanating substance is placed into a containment center (e.g., the containment center 20 shown in FIG. 1). The containment center is generally airtight and can contain one or more clear, see-through, or transparent portions in order to make visible the interior of containment center. The containment center may also be entirely clear, transparent, or opaque. In implementations, manipulation, heating, vaporizing, smoking or other combustion of materials such as the odor emanating substance can result in the creation of scents, aerosols, vapors, particulates and other smells within the containment center.

At block 904, a first pathway leading from the containment center to a user is created. The first pathway (e.g., the first pathway 30 shown in FIG. 1) is configured to enable the odors to travel without seeping into the outside environment. The first pathway may be releasably coupled with a mouthpiece (e.g., the mouthpiece 32 shown in FIG. 1). The first pathway and mouthpiece can be composed of a variety of materials, including plastics, metals, or any other type of airtight material, whether flexible or rigid, that can be configured into a tube or path through which contaminated air can travel.

At block 906, a second, pressurized pathway leading back into the containment center is created. The second pathway (e.g., the second pathway 40 shown in FIG. 1) is configured to enable the odors to travel without seeping into the outside environment. The second pathway may be releasably coupled with a mouthpiece (e.g., the mouthpiece 42 shown in FIG. 1). The second pathway and mouthpiece can be composed of a variety of materials, including plastics, metals, or any other type of airtight material, whether flexible or rigid, that can be configured into a tube or path through which contaminated air can travel.

At block 908, a third, pressurized pathway leading from the containment center to the outside environment is created. The third pressurized pathway (e.g., the third pathway 50 shown in FIG. 1) may be configured to reduce odors released into the environment and/or direct odors through an available door or window. The third pathway may be coupled with a pressurized exhaust (e.g., the pressurized exhaust 52 shown in FIG. 1). The third pathway can be composed of a variety of materials, including plastics, metals, or any other type of airtight material, whether flexible or rigid, that can be configured into a tube or path through which contaminated air can travel.

Figure 10:
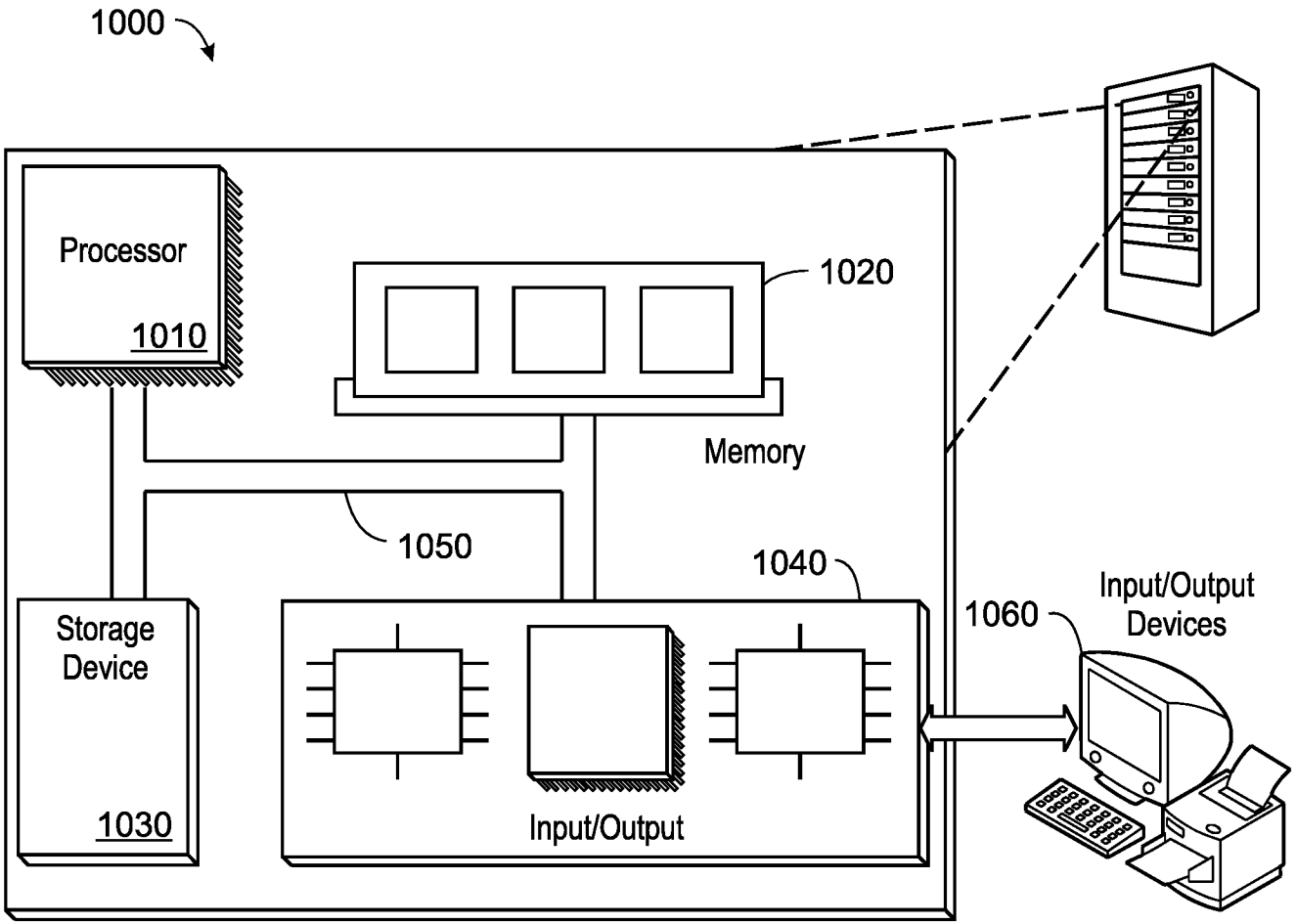
FIG. 10 is a block diagram of one implementation of an example computer system.

FIG. 10 is a block diagram of an example computer system 1000. For example, referring to FIG. 1, pressurized intake 46, user interface 48, user interface 54, or pressurized exhaust 52 could be a part of an example of the system 1000 described here. Moreover, a user interface, pressurized intake 46, pressurized exhaust 52, or the air flow director 75 as described in FIGS. 6-8 may be part of an example of the system 1000 described here. The system 1000 includes a processor 1010, a memory 1020, a storage device 1030, and one or more input/output interface devices 1040. Each of the components 1010, 1020, 1030, and 1040 can be interconnected, for example, using a system bus 1050.

The processor 1010 is capable of processing instructions for execution within the system 1000. The term "execution" as used here refers to a technique in which program code causes a processor to carry out one or more processor instructions. The processor 1010 is capable of processing instructions stored in the memory 1020 or on the storage device 1030. The processor 1010 may execute operations such as control of a pressurized intake, control or a pressurized exhaust, or adjustment of apertures.

The memory 1020 stores information within the system 1000. In some implementations, the memory 1020 is a computer-readable medium. In some implementations, the memory 1020 is a volatile memory unit. In some implementations, the memory 1020 is a non-volatile memory unit.

The storage device 1030 is capable of providing mass storage for the system 1000. In some implementations, the storage device 1030 is a non-transitory computer-readable medium. In various different implementations, the storage device 1030 can include, for example, a hard disk device, an optical disk device, a solid-state drive, a flash drive, magnetic tape, or some other large capacity storage device. In some implementations, the storage device 1030 may be a cloud storage device, e.g., a logical storage device including one or more physical storage devices distributed on a network and accessed using a network. In some examples, the storage device may store long-term data, such as user profiles with preferences for pressurized intake settings, preferences for pressurized exhaust settings, and/or preferences for aperture settings. Preset settings corresponding to the material placed within the containment center may also be stored. The input/output interface devices 1040 provide input/output operations for the system 1000. In some implementations, the input/output interface devices 1040 can include one or more of a network interface devices, e.g., an Ethernet interface, a serial communication device, e.g., an RS-232 interface, and/or a wireless interface device, e.g., an 802.11 interface, a 3G wireless modem, a 7G wireless modem, etc. A network interface device allows the system 1000 to communicate, for example, transmit and receive such data. In some implementations, the input/output device can include driver devices configured to receive input data and send output data to other input/output devices, e.g., keyboard, printer and display devices 1060. In some implementations, mobile computing devices, mobile communication devices, and other devices can be used.

A server or database system can be distributively implemented over a network, such as a server farm, or a set of widely distributed servers or can be implemented in a single virtual device that includes multiple distributed devices that operate in coordination with one another. For example, one of the devices can control the other devices, or the devices may operate under a set of coordinated rules or protocols, or the devices may be coordinated in another fashion. The coordinated operation of the multiple distributed devices presents the appearance of operating as a single device.

In some examples, the system 1000 is contained within a single integrated circuit package. A system 1000 of this kind, in which both a processor 1010 and one or more other components are contained within a single integrated circuit package and/or fabricated as a single integrated circuit, is sometimes called a microcontroller. In some implementations, the integrated circuit package includes pins that correspond to input/output ports, e.g., that can be used to communicate signals to and from one or more of the input/output interface devices 1040.

Although an example processing system has been described in FIG. 10, implementations of the subject matter and the functional operations described above can be implemented in other types of digital electronic circuitry, or in computer software, firmware, or hardware, including the structures disclosed in this specification and their structural equivalents, or in combinations of one or more of them. Implementations of the subject matter described in this specification, such as control of a pressurized intake, control or a pressurized exhaust, or adjustment of apertures can be implemented as one or more computer program products, i.e., one or more modules of computer program instructions encoded on a tangible program carrier, for example a computer-readable medium, for execution by, or to control the operation of, a processing system. The computer readable medium can be a machine readable storage device, a machine readable storage substrate, a memory device, or a combination of one or more of them.

The term "system" may encompass all apparatus, devices, and machines for processing data, including by way of example a programmable processor, a computer, or multiple processors or computers. A processing system can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, executable logic, or code) can be written in any form of programming language, including compiled or interpreted languages, or declarative or procedural languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

Computer readable media suitable for storing computer program instructions and data include all forms of non-volatile or volatile memory, media and memory devices, including by way of example semiconductor memory devices, e.g., EPROM, EEPROM, and flash memory devices; magnetic disks, e.g., internal hard disks or removable disks or magnetic tapes; magneto optical disks; and CD-ROM, DVD-ROM, and Blu-Ray disks. The processor and the memory can be supplemented by, or incorporated in, special purpose logic circuitry. Sometimes a server is a general purpose computer, and sometimes it is a custom-tailored special purpose electronic device, and sometimes it is a combination of these things. Implementations can include a back end component, e.g., a data server, or a middleware component, e.g., an application server, or a front end component, e.g., a client computer having a graphical user interface or a Web browser through which a user can interact with an implementation of the subject matter described is this specification, or any combination of one or more such back end, middleware, or front end components. For example, the functionality described herein may be realized through an application or "app." The app may be located on the device as described herein. The app may also be located on a second device communicatively coupled with a device as described herein. The components of the system can be interconnected by any form or medium of digital data communication, e.g., a communication network. Examples of communication networks include a local area network ("LAN") and a wide area network ("WAN"), e.g., the Internet. The components of the system may also communicate via short range wireless communication standard, such as Bluetooth.

A number of embodiments of the invention have been described. Nevertheless, it will be understood that various modifications may be made without departing from the spirit and scope of the invention.

The invention claimed is:

1. An odor containment and elimination device, comprising:

a heating chamber configured to receive an odorous item that emits a contaminated air including an odor;

a first release point configured for inhalation of the contaminated air by a user;

a first intake including a mouthpiece dimensioned to cover at least one of a mouth and nose of a user, and configured to draw in an exhaled air from at least one of the mouth or nose of the user;

a first pressurized pathway in fluid communication with an outside environment via the first intake; and a second pressurized pathway configured to reduce the contaminated air released into the outside environment from the heating chamber, or to reduce the contaminated air released into the outside environment from the first pressurized pathway.

2. The device of claim 1, further comprising an air flow director in fluid communication with at least one of the first pressurized pathway and the second pressurized pathway.

3. The device of claim 1, wherein the mouthpiece includes multiple offshoots.

4. The device of claim 1, wherein the first release point includes multiple offshoots.

5. The device of claim 1, wherein a tether is positioned at the first release point and configured to attach to a portion of a user.

6. The device of claim 1, wherein a tether is positioned at the mouthpiece and configured to attach to a portion of a user.

7. The device of claim 1, wherein the mouthpiece is configured to be freestanding.

8. The device of claim 1, wherein the heating chamber is configured to emit the contaminated air emitted in a controlled manner at the first release point.

9. The device of claim 1, wherein the heating chamber includes a heat source positioned therein.

10. The device of claim 1, further comprising an air quality detector configured to measure a contamination level of the outside environment.

11. The device of claim 1, further comprising an air quality detector positioned within the first intake and configured to determine a contamination level of the contaminated air.

12. The device of claim 1, wherein the first pressurized pathway and the second pressurized pathway are combined as a single pathway.

13. An odor containment and elimination device, comprising:

a heating chamber configured to receive an odorous item that emits a contaminated air including an odor, the heating chamber comprising a transparent portion therein;

a first release point, configured to allow for inhalation of the contaminated air by a user;

a first intake configured to draw in exhaled air from at least one of the mouth and the nose of the user;

a first pressurized pathway in fluid communication with an outside environment via the first intake; and a second pressurized pathway configured to reduce the contaminated air released into the outside environment from the heating chamber, or to reduce the contaminated air released into the outside environment from the first pressurized pathway.

14. The device of claim 13, wherein the heating chamber includes an adjustable connector positioned therein, the adjustable connector being configured to receive the odorous item.

15. The device of claim 13, wherein the first pressurized pathway and the second pressurized pathway are combined as a single pathway.

16. The device of claim 13, wherein the heating chamber includes an adjustable aperture positioned between the heating chamber and the first pressurized pathway.

17. The device of claim 13, wherein the heating chamber includes an adjustable aperture positioned between the heating chamber and at least one of the first pressurized pathway and the second pressurized pathway.

18. The device of claim 13, wherein a tether is positioned at the first release point and configured to attach to a portion of a user.

19. The device of claim 13, wherein the heating chamber is configured to emit the contaminated air emitted in a controlled manner at the first release point.

20. The device of claim 13, wherein the heating chamber includes a heat source positioned therein.

21. The device of claim 13, further comprising an air quality detector configured to measure a contamination level of the outside environment, or positioned within the first intake and configured to determine a contamination level of the contaminated air.

22. An odor containment and elimination device, comprising:

a heating chamber configured to receive an odorous item that emits a contaminated air including an odor, the heating chamber comprising a transparent portion therein;

a first pressurized pathway configured to receive at least a portion of the contaminated air from the heating chamber and direct it to a release point in fluid communication with an outside environment; and a second pressurized pathway configured to receive at least a portion of an exhaled air directly from at least one of a mouth or a nose of a user, and to direct the exhaled air to the release point.

23. The device of claim 22, wherein the first pressurized pathway and the second pressurized pathway are combined as a single pathway.

24. The device of claim 22, wherein the heating chamber includes an adjustable aperture positioned between the heating chamber and at least one of the first pressurized pathway and the second pressurized pathway.

25. The device of claim 22, wherein the heating chamber includes a heat source positioned therein.

26. The device of claim 22, wherein the second pressurized pathway is configured to receive at least a portion of the exhaled air directly from at least one of the mouth or the nose of the user without the exhaled air passing through the outside environment.

27. An odor containment and elimination device, comprising:

a first pressurized pathway configured to collect at least a portion of contaminated air from an odorous item that emits a contaminated air including an odor; and a mouthpiece dimensioned to cover at least one of a mouth and a nose of a user that is paired with a second pressurized pathway in fluid communication with an outside environment and configured to receive at least a portion of an exhaled air by the user through the mouthpiece, and to direct the contaminated air through a filter to a release point in fluid communication with the outside environment.

28. The device of claim 27, wherein a positon of the first pressurized pathway is fixed relative to a material holder configured to contain the odorous item.

29. The device of claim 27, wherein a positon of the mouthpiece and the second pressurized pathway is fixed relative to the user's face.

30. The device of claim 27, wherein the first pressurized pathway is adjustable to seal against a surface of a material holder configured to contain the odorous item.

* * * * *